United States Patent [19]

Fenimore

[11] Patent Number: 4,507,037

[45] Date of Patent: Mar. 26, 1985

[54] APPARATUS AND METHOD FOR HEAD AND TAIL TRIMMING BOOKLETS

[76] Inventor: Harry L. Fenimore, P.O. Box 1222, Chickasha, Okla. 73018

[21] Appl. No.: 451,681

[22] Filed: Dec. 20, 1982

[51] Int. Cl.[3] ..... B42C 13/04; B42C 19/12; B26D 7/06

[52] U.S. Cl. ..... 412/11; 412/16; 83/426; 83/493; 83/503

[58] Field of Search ..... 412/11, 16; 83/344, 83/345, 339, 426, 493, 503

[56] References Cited

U.S. PATENT DOCUMENTS

| | | | |
|---|---|---|---|
| 647,053 | 4/1900 | Underwood . | |
| 1,389,762 | 9/1921 | Juengst | 412/16 |
| 1,873,792 | 8/1932 | Sheeler | 83/426 |
| 2,312,550 | 3/1943 | Hornbostel | 83/493 |
| 2,872,980 | 2/1959 | Perrine | 164/60 |
| 2,922,171 | 1/1960 | Kleineberg et al. | 412/16 |
| 3,545,326 | 12/1970 | Madachy | 83/503 |
| 4,046,043 | 9/1977 | Kistner et al. . | |

*Primary Examiner*—Paul A. Bell
*Assistant Examiner*—Taylor J. Ross
*Attorney, Agent, or Firm*—Robert K. Rhea

[57] ABSTRACT

In a booklet binding machine a flat cover signature is added in leading edge register to a single or collated signatures moving in a travel path prior to saddle folding. The signatures are passed as a unit to a stitching station to be jogged and center stitched. Overlapping pairs of arbor mounted rotary slitting blades at opposing sides of the travel path head and tail trim the signatures during its movement by feed rollers between the pairs of slitting blades. The uppermost arbor and blades are angularly rotated at a greater speed than the lowermost blades to insure a clean cut of the signatures. Cooperating presser rings on the arbors cooperate with the slitting blades prevent buckling of the signatures and strip tail-out of the trimmed edges thereof. Bearings mounting the uppermost presser rings on the upper arbor allow the uppermost rings to rotate at the rate of travel of the lowermost rings.

13 Claims, 5 Drawing Figures

APPARATUS AND METHOD FOR HEAD AND TAIL TRIMMING BOOKLETS

BACKGROUND OF THE INVENTION

1. Field of the Invention

The present invention relates to binding and trimming booklets and more particularly to an apparatus and method of adding a flat cover signature to a single or collated signatures and head and tail trimming the booklets following center stitching prior to or following saddle folding.

2. Description of the Prior Art

Prior attempts to add a cover signature in register with a single or collated signatures moved past a cover signature hopper and transfer drum station by a tape conveyor have generally been unsuccessful. This invention accomplishes this function by a sensor actuated by the leading edge of a single or collated signatures which triggers a mechanical clutch angularly rotating the cover signature transfer drum.

U.S. Pat. No. 2,872,980 discloses a strip trimming apparatus which discloses rotating slitter blades trimming opposing sides of a strip wherein the angle of the cutting blades is adjusted with respect to the axis of the strip passing between the cutter in an attempt to prevent strip tail-out or a buckling inward of the strip material between the opposing cutter blades principally caused by the slitter blades constantly forcing the strip material inwardly.

U.S. Pat. No. 647,053 discloses a trimmer for wallpaper, or the like, teaching the value of different speeds for one pair of cutters relative to an opposed cooperating pair, however, in processing a single thickness of strip material support of the material between opposing blades is not as critical as when slitting or head and tail trimming multiple sheet booklets or folded material.

This invention overcomes the disadvantages of the above patents by correcting the tail-out problem at its source by clean cutting slitters which includes a lower pair of roating circular cutting blades or slitters at opposing ends of a booklet to be head and tail trimmed with an upper cooperating pair of circular blade slitters angularly rotated at a rate of rotation greater than the lower pair. Further, the invention provides a support for the bottom surface of the booklet being trimmed in the area between the infeeding rollers prior to slitting and between the slitter arbors and the next set of pull-out rollers which enhances the desired result, namely, clean cutting slitting.

SUMMARY OF THE INVENTION

In a booklet assembly machine having several stations for processing the booklet forming signatures, the signatures are progressively moved along a travel path from one station to another by tape conveyors. A single or collated signatures are moved by a tape conveyor toward a cover signature station which actuates a sensor triggering a mechanical clutch in a drive train connected with a cover signature transfer drum to add the cover. The signatures are then moved as a registered unit to the next station where the signatures are jogged and center stitched and subsequently head and tail trimmed at the next station before being folded and face trimmed at the final station.

In the head and tail trimming station two pairs of circular blades are respectively mounted on upper and lower arbors supported by the booklet assembly machine frame. The pairs of cutters are spaced-apart a selected distance according to the predetermined booklet size with the upper pair of blades cooperatively arranged with the lower pair of blades to form a cutting or slitting action on sheet material passed therebetween in the travel path normal to the axis of the arbors, the upper pair of blades being driven at an angular rate of rotation greater than the lower pair fo blades. Each pair of the blades is secured to pairs of hubs surrounding the respective arbor and attached thereto, and hubs of the lower arbor blades, having a resilient roller or ring therearound, are rotated at the rate of angular rotation of the lower arbor and angular rate of rotation of infeeding rollers moving signatures to be slit. The hubs on the upper arbor have a surrounding needle bearing supporting a resilient roller or ring for contact with the upper surface of the signature being trimmed in a free running action cooperating with the angular rate of rotation of the lower arbor booklet supporting rollers independently of the angular rate of rotation of the upper arbor.

The principal objects of this invention are to provide a booklet assembly and head and tail trimming apparatus having a cover signature station adding a cover signature in leading edge register with a single or collated signatures moved by a tape conveyor and having circular slitting blades forming a clean cutting action on the head and tail ends of multiple signature booklets prior to or following folding of the booklets in which the material being trimmed is supported during the trimming action in a manner to prevent tail-out and in which the clean cutting action is achieved by angular rotation of one pair of slitting blades at a speed greater than the opposing cooperating pair of slitting blades.

DESCRIPTION OF THE PREFERRED EMBODIMENTS

Figure 1:
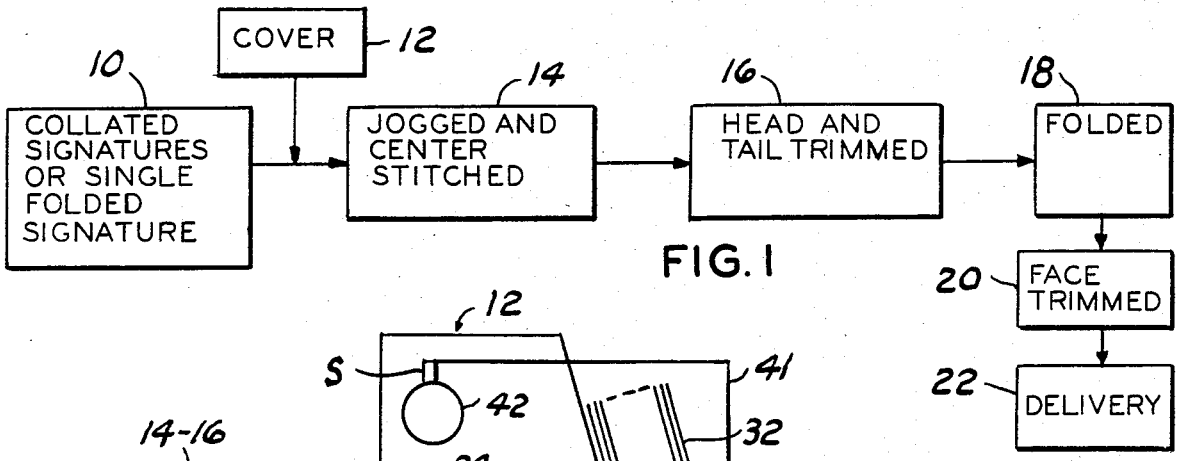
FIG. 1 is a flow diagram.

Like characters of reference designate like parts in those figures of the drawings in which they occur.

In the drawings:

Referring to FIG. 1, collated signatures or a single folded signature at station 10 are moved to station 12 to receive a flat cover signature which are then moved to and jogged and center stitched at station 14; head and tail trimmed by a rotary cutter at station 16; subsequently folded along the stitched center at station 18; face trimmed at station 20; and, the final center stitch folded and trimmed booklet delivered at station 22.

Head and tail trimming of the booklet is preferably done at station 16 prior to folding the booklet for the reason a thicker booklet may be trimmed since the trimming blades act on one-half the thickness of the final folded booklet, however, the function of stations 16 and 18 may be reversed with the booklet being head and tail trimmed at station 16 following the folding of the booklet at station 18.

Figure 2:
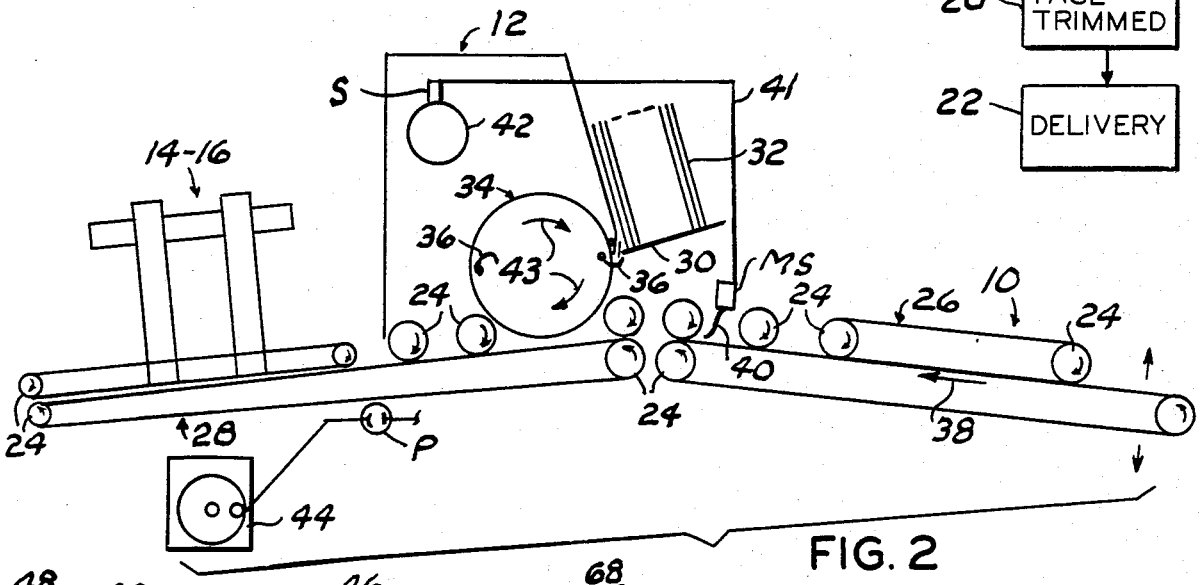
FIG. 2 is a mechanical diagram.

FIG. 2 diagrammatically illustrates a booklet, not shown, passing through stations 10 through 16 of FIG. 1 wherein a plurality of rollers or tape wheels 24 form tape conveyors 26 and 28 progressively moving the signatures forming the booklet toward the left, as viewed in FIG. 2, wherein the jogging, center stitching and head and tail trimming stations 14 and 16 are combined as a single station.

The cover signature station 12 is interposed between station 10 and stations 14–16. The cover signature station includes a hopper 30 containing a plurality of single sheet or folded cover signatures 32 positioned adjacent a rotor or cover signature transfer drum 34 transversely overlying a collated signature travel path and having grippers 36 for adding a cover signature 32 to each unit of collated signatures passing thereunder with each 180° angular rotation of the drum. The collated signatures are moved along the vertically adjustable tape conveyor 26 in the direction of a signature travel path, indicated by the arrow 38, and the leading edge thereof contacts the switch arm 40 of a microswitch MS connected with a source of electrical energy, not shown, and electrically connected by a wire 41 with a solenoid S. The solenoid S is operatively connected with a mechanical clutch 42 forming a part of the substantially conventional transfer drum drive train which drives the transfer drum 34 in the direction of the arrows 43 in sequence with the position of the respective units of collated signatures. The microswitch MS is adjustable longitudinally of the feeding conveyor 26 for timing with the infeeding of the cover signature 32 to assure registration of the cover signature 32 with the single or collated signatures. The success of the grouping of the two signatures depends on the grippers maintaining their grip on the material until both signatures are clamped by the laterally adjustable rollers or tape wheels.

Obviously, the microswitch MS may be disconnected or removed when cover signatures are not being added to the material to be processed. The cover signature station 12 may be utilized for adding insert signatures to the booklet forming material or act as a free standing station for feeding previously assembled signatures to the booklet processing travel path.

The signatures are then moved by the tape conveyor 28 toward the jogging, center stitching and trimming stations 14–16 where a photoelectric cell P or other switch means, not shown, responsive to movement of the signatures, actuates a clutch crank and arm 44 for center stitching the signatures.

Figure 3:
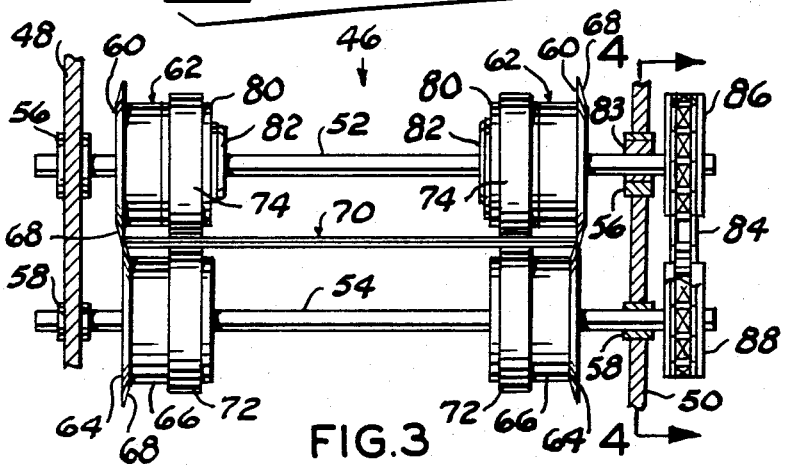
FIG. 3 is an elevational view, partially in section, of the slitter assembly, illustrating the material support and signature slitting action.
Figure 4:
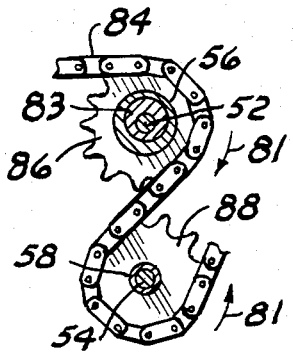
FIG. 4 is an elevational view, partially in section, looking in the direction of the arrows 4—4 of FIG. 3 with the supporting framework removed for clarity; and, FIG. 5 is an exploded perspective view of one of the slitter blades and signature support hubs.
Figure 5:
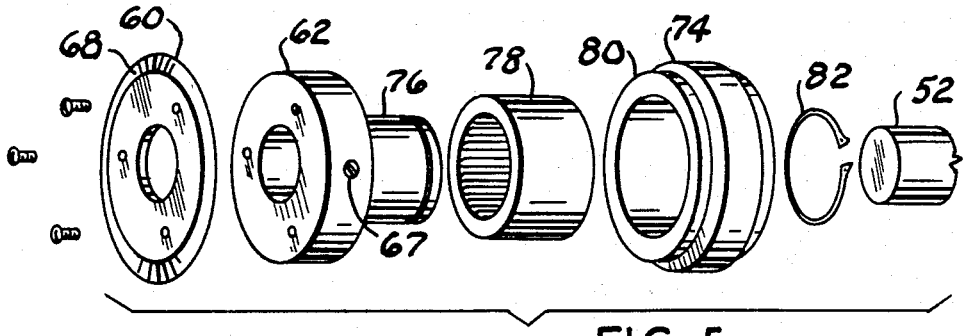

Referring also to FIGS. 3, 4 and 5, the numeral 46 indicates a booklet head and tail trimming assembly interposed transversely of the travel path and supported by opposing parallel frame side members 48 and 50. The trimming assembly 46 comprises upper and lower shaft-like arbors 52 and 54 disposed in vertically spaced parallel relation and journalled by bearings 56 and 58 secured to the frame members 48 and 50. A pair of disk-like blades or slitters 60 are coaxially secured to the upper arbor 52 in selected spaced relation longitudinally of the arobor by a pair of hubs 62 of selected diameter projecting inwardly of the blades in confronting relation. Similarly, a second pair of disk-like blades or slitters 64 are coaxially mounted on the lower arbor 54 by a second pair of hubs 66. The hubs 62 and 66 are secured to the respective arbor by set screws 67, only one being shown (FIG. 5).

The blades 60 and 64 are relatively thin when compared with their diameter and are characterized by a tapered or beveled edge surface 68 on one side at their peripheral edge portion to form a sharpened knife-like peripheral edge for the respective blade. The respective blades 60 and 64, at the respective end portion of the arbors, are disposed in cooperative relation so that the flat surface opposite the beveled surface of each blade is disposed adjacent a vertical plane so that a peripheral portion of the blades may overlap slightly at their meeting edges to insured scissor-like head and tail trimming of center stitched signatures, indicated by the lines 70, passing therebetween. During the head and tail trimming or slitting action of the signatures the beveled surfaces 68 of one pair of blades tend to buckle the signatures inwardly during the final two to three inches of the slitting action resulting in a tail-out in which the edges of the booklet are longer than its central axis. This buckling and resulting tail-out is overcome by mounting a pair of annular presser rollers or rings 72 of resilient material, such as rubber, or the like, on the lower pair of hubs 66 for contactably supporting and enhancing the drive forcing the signatures 70, when formed from "soft" stock, toward the slitting blades. Similarly, a second pair of resilient rings 74 are mounted on the upper hubs 62 in cooperative relation with respect to the lower rings 72 for contact with the upper surface of the signatures 70, however, since the upper arbor 52 angular rate of rotation is preferably greater than the lower arbor 54, as presently explained, the hubs 62 are provided with a diametrically reduced hub portion 76 opposite the respective blade 60 for receiving a needle bearing 78 in turn press fitted into a sleeve 80 having an outside diameter equal with respect to the larger diameter of the hub 62. The sleeve 80 has one of the resilient rings 74 secured thereon. A snap ring 82, cooperatively received by a groove on the smaller hub 76, maintains the assembled needle bearing and sleeve on the hub 62.

To compensate for booklet thickness as between a thin and thick booklet, for example, one containing a single signature and cover signature and one containing a plurality of signatures and its cover signature, during the head and tail trimming the upper bearings 56 are provided with an eccentric 83 surrounding the upper arbor 52 to increase or decrease the spacing between the pairs of resilient rings 72 and 74 and to vary the overlap of the slitter blades.

The arbors and pairs of blades are driven, in the direction of the arrows 81 (FIG. 4), by a chain 84 entrained around upper and lower cooperating sprockets 86 and 88 respectively secured to one end portion of the arbors 52 and 54 projecting outwardly beyond the frame member 50. The upper sprocket 86 is preferably provided with less teeth than the lower sprocket 88, for example, the upper sprocket contains fourteen teeth and the lower sprocket 88 fifteen teeth, thus increasing the angular rate of rotation of the upper sprocket approximately 7% greater than the angular rotation of the lower sprocket. The increased angular rate of rotation of the upper blades 60 with respect to the lower blades 64 enhances the clean cutting or slitting action on the signatures 70 and tends to eliminate, in combination with the resilient rings 72 and 74, any tail-out of the signatures.

Obviously the invention is susceptible to changes or alterations without defeating its practicability. Therefore, I do not wish to be confined to the preferred embodiment shown in the drawings and described herein.

I claim:

1. In a booklet binding machine having a housing defining a travel path for moving a series of collated signatures in single file therethrough and having a cover signature station adjacent the travel path, including an electrically operated mechanical clutch drivably connected with a transfer drum, and a jogging and stitching station for center stitching the signatures, the improvement comprising:

sensing means including an electrical switch having a switch arm interposed in the travel path for connecting a source of electrical energy with and actuating said clutch to angularly rotate the transfer drum and deposit a cover signature in the travel path in leading edge register with a signature or signatures in response to the leading edge of a signature or signatures contacting said switch arm.

2. The combination according to claim 1 and further including:

slitting means disposed transversely of the travel path for head and tail trimming the stitched signatures, said slitting means including, a pair of arbors jounalled in vertically spaced relation by said housing and forming a continuation of the travel path therebetween, a pair of circular blades secured to each arbor of said pair of arbors in cooperative signature slitting relation on opposing sides of the travel path, means for angularly rotating the lowermost arbor at a rate cooperative with the movement of the signatures along the travel path and angularly rotating the uppermost arbor at a rate greater than the rate of angular rotation of the lowermost arbor, and, signature feed and presser roller means mounted respectively on the lowermost and uppermost arbor for cooperative rotation about the axis of the respective arbor with the rate of travel of the signatures.

3. The combination according to claim 2 in which said arbor rotating means includes:

a pair of sprockets cooperatively secured to said arbors, one said sprocket having a smaller number of teeth than the other said sprocket; and, means including a chain entrained around said sprockets for driving said sprockets in opposing directions.

4. The combination according to claim 2 in which said roller means includes:

upper and lower pairs of hubs respectively secured to said pair of arbors in cooperative spaced-apart relation longituidnally of the respective arbor;

upper and lower pairs of resilient rings respectively carried by the periphery of the respective pair of hubs; and, bearing means interposed between the uppermost pair of hubs and said upper pair of resilient rings for angular rotation of said upper pair of resilient rings independently of the rate of angular rotation of said upper pair of hubs.

5. The combination according to claim 4 in which said arbor rotating means includes:

a pair of sprockets cooperatively secured to said arbors, one said sprocket having a smaller number of teeth than the other said sprocket; and, means including a chain entrained around said sprockets for driving said sprockets in opposing directions.

6. The combination according to claim 4 and further including:

eccentric bearing means journalling the uppermost said arbor for adjusting the vertical spacing between said pair of arbors.

7. The combination according to claim 3 and further including:

eccentric bearing means journalling the uppermost said arbor for adjusting the vertical spacing between said pair of arbors.

8. In a booklet binding machine having a housing defining a travel path for moving a series of collated signatures in single file therethrough and having a jogging and stitching station for center stitching the signatures, the improvement comprising:

slitting means disposed transversely of the travel path for head and tail trimming the stitched signatures, said slitting means including, a pair of arbors journalled in vertically spaced relation by said housing and forming a continuation of the travel path therebetween, a pair of circular blades secured to each arbor of said pair of arbors in cooperative signature slitting relation on opposing sides of the travel path, means for angularly rotating the lowermost arbor at a rate cooperative with the movement of the signatures along the travel path and angularly rotating the uppermost arbor at a rate greater than the rate of angular rotation of the lowermost arbor, and, signature feed and presser roller means mounted respectively on the lowermost and uppermost arbor for cooperative rotation about the axis of the respective arbor with the rate of travel of the signatures.

9. The combination according to claim 8 in which said arbor rotating means includes:

a pair of sprockets cooperatively secured to said arbors, one said sprocket having a smaller number of teeth than the other said sprocket; and, means including a chain entrained around said sprockets for driving said sprockets in opposing directions.

10. The combination according to claim 8 in which said roller means includes:

upper and lower pairs of hubs respectively secured to said pair of arbors in cooperative spaced-apart relation longitudinally of the respective arbor;

upper and lower pairs of resilient rings respectively carried by the periphery of the respective pair of hubs; and, bearing means interposed between the uppermost pair of hubs and said upper pair of resilient rings for angular rotation of said upper pair of resilient rings independently of the rate of angular rotation of said upper pair of hubs.

11. The combination according to claim 10 in which said arbor rotating means includes:

a pair of sprockets cooperatively secured to said arbors, one said sprocket having a smaller number of teeth than the other said sprocket; and, means including a chain entrained around said sprockets for driving said sprockets in opposing directions.

12. The combination according to claim 10 and further including:

eccentric bearing means journalling the uppermost said arbor for adjusting the vertical spacing between said pair of arbors.

13. The combination according to claim 9 and further including:

eccentric bearing means journalling the uppermost said arbor for adjusting the vertical spacing between said pair of arbors.

* * * * *